US007574767B2

(12) United States Patent
Michaels et al.

(10) Patent No.: US 7,574,767 B2
(45) Date of Patent: Aug. 18, 2009

(54) CLEANING IMPLEMENT

(75) Inventors: Kenneth W. Michaels, Spring Grove, IL (US); Padma Prabodh Varanasi, Racine, WI (US); Joel E. Adair, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 162 days.

(21) Appl. No.: 11/847,434

(22) Filed: Aug. 30, 2007

(65) Prior Publication Data

US 2008/0060156 A1 Mar. 13, 2008

Related U.S. Application Data

(60) Provisional application No. 60/842,841, filed on Sep. 7, 2006.

(51) Int. Cl.
*A47L 13/12* (2006.01)
*A47L 13/11* (2006.01)

(52) U.S. Cl. ..... 15/121; 15/245; 15/220.1

(58) Field of Classification Search ..... 15/121, 15/245, 220.1, 240.1, 244.1
See application file for complete search history.

(56) References Cited

U.S. PATENT DOCUMENTS

| | | | | |
|---|---|---|---|---|
| 1,376,195 | A | 4/1921 | Fernandez | |
| 1,828,715 | A | 10/1931 | Oishei | |
| 2,188,114 | A | 1/1940 | Hubbard | |
| 2,518,765 | A | 8/1950 | Ecker | |
| 2,625,700 | A | 1/1953 | Baldwin | |
| 2,631,326 | A * | 3/1953 | Smith, Jr. | 15/364 |
| 2,644,974 | A | 7/1953 | Anderson | |
| 2,715,745 | A | 8/1955 | Jacobsen | |
| 2,722,701 | A | 11/1955 | Blum | |
| 3,631,561 | A * | 1/1972 | Aszkenas | 15/250.41 |
| 5,469,594 | A | 11/1995 | Nolte | |
| 5,970,560 | A | 10/1999 | Leroux | |
| 6,090,447 | A * | 7/2000 | Suzuki et al. | 427/336 |
| 6,092,255 | A | 7/2000 | Kim | |
| 6,319,332 | B1 | 11/2001 | Gavney et al. | |
| 6,668,418 | B2 | 12/2003 | Bastien | |
| 6,702,497 | B1 | 3/2004 | Tien | |
| 6,820,299 | B2 | 11/2004 | Gavney | |
| 6,872,021 | B1 | 3/2005 | Wilson et al. | |
| 2005/0198757 | A1 * | 9/2005 | Gavney et al. | 15/114 |

FOREIGN PATENT DOCUMENTS

| | | |
|---|---|---|
| DE | 9104490 U1 | 7/1991 |
| DE | 4330271 A1 | 3/1995 |

OTHER PUBLICATIONS

PCT/US2007/019175 International Search Report and Written Opinion dated Jun. 2, 2008.
U.S. Appl. No. 11/689,696, Billig, J., et al., filed Mar. 22, 2007.
PCT US07/007103, Billig, J., et al., filed Mar. 22, 2007.

* cited by examiner

*Primary Examiner*—Shay L Karis

(57) ABSTRACT

A cleaning implement is disclosed which is of a multifunctional type. In one form it has a squeegee blade sandwiched by absorbents on both sides. The absorbents can absorb cleaning fluid, and do so when the squeegee is moved in multiple directions. In another form the squeegee blade is sandwiched by the substrates, but has through holes such that used cleaning liquid that is driven off the window by the squeegee is collected in a different substrate from a substrate that delivers fresh cleaning liquid to the surface being cleaned.

12 Claims, 6 Drawing Sheets

FIG. 6
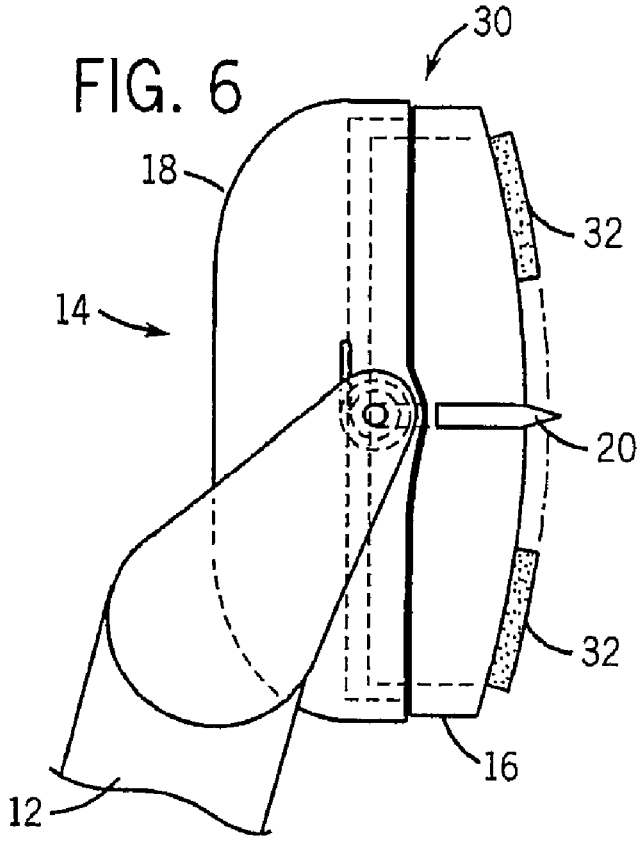
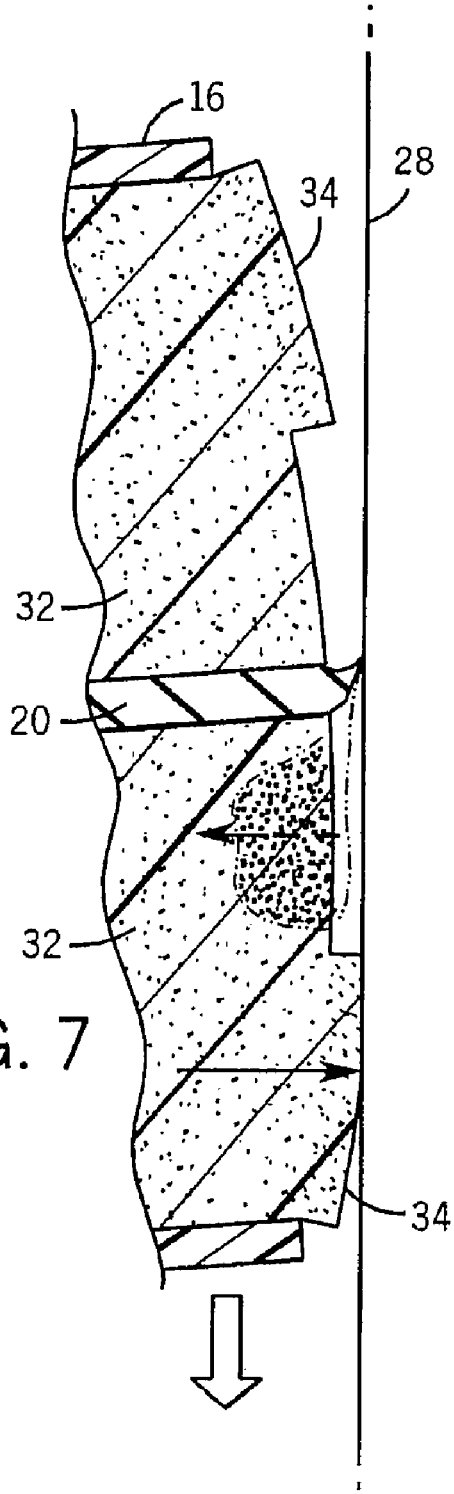
FIG. 7

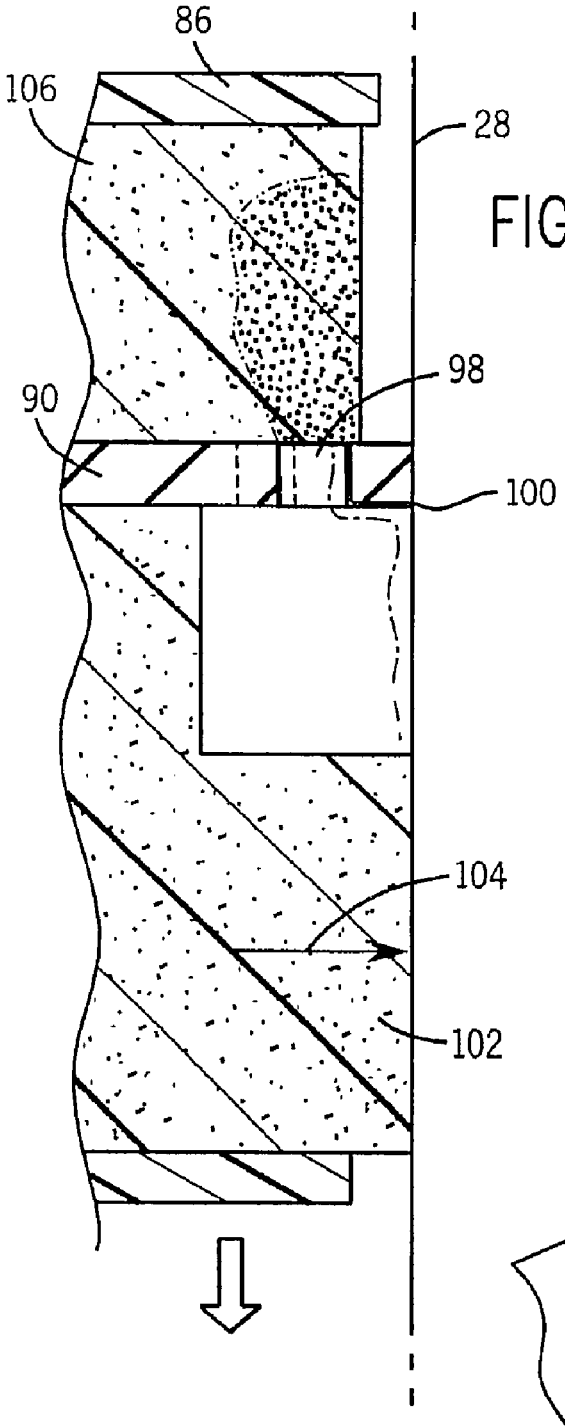
FIG. 13
FIG. 14
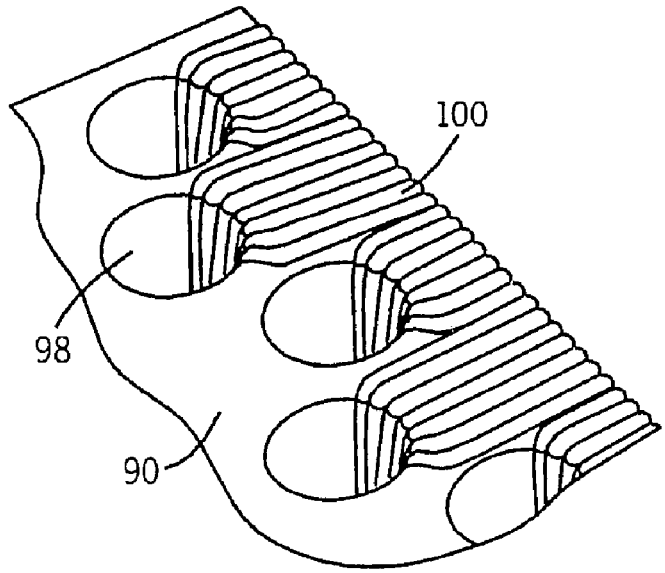

CLEANING IMPLEMENT

CROSS-REFERENCE TO RELATED APPLICATIONS

This application claims priority on U.S. provisional application 60/842,841, filed Sep. 7, 2006.

STATEMENT REGARDING FEDERALLY SPONSORED RESEARCH/DEVELOPMENT

Not applicable.

BACKGROUND OF THE INVENTION

The present invention relates to devices for cleaning windows and other hard surfaces. More particularly, it relates to multi-function type devices that optionally deliver a cleaning fluid, and in any event work cleaning fluid along the surface being cleaned, squeegee the used liquid off the surface, and collect the used liquid.

Cleaning of windows and other hard surfaces typically requires several tools and is a multi-step process. One typically picks up a spray bottle and sprays the window, then picks up a sponge or cloth and works the cleaning fluid along the window glass, then picks up a squeegee to drive the used cleaning fluid off the window, then dries the remaining "drool" with a rag or the like. Hence, several devices are required, and additional time is needed to shift from device to device. Moreover, this process may leave wet and soiled paper or rags to be dealt with or disposed of.

There have been attempts to collect liquid as it is being squeegeed off windows or other surfaces, using wicking or absorbent layers adjacent the squeegee blade. See e.g., U.S. Pat. Nos. 2,625,700, 5,970,560, 6,092,255 and 6,668,418. Even when using such devices one still needs to use a separate spray bottle. Further, such devices typically are designed for unidirectional movement (e.g. a downward pull).

While there have been a variety of attempts to incorporate a source of cleaning fluid into a cleaning device (see eg. U.S. Pat. No. 6,872,021), most of these devices do not provide the capability for collecting the squeegee "drool". While this is not a serious problem for automobile use, or for use on the outside of buildings, use on the interior surfaces of building windows can be problematic, particularly where sensitive paint or flooring is adjacent the window being cleaned.

U.S. Pat. No. 1,376,195 discloses a window cleaning device in which there is a reservoir containing cleaning liquid that impregnates a moistening element/sponge. Adjacent to that is a squeegee which collects the liquid and drives it to an adjacent catch reservoir on the device. Similarly, U.S. Pat. No. 2,722,701 discloses a device which supplies a cleaning liquid, squeegees it off the window, and collects at least some of it in an adjoining absorbent pad region. However, with these devices, once the liquid is used up or the collection capacity of the device exceeded, it is difficult to adapt the device for continued use. Moreover, the devices are not compact and carry unnecessary weight. In any event, such devices have deficiencies when used in multidirectional environments.

While replaceable cartridges have been used in a variety of contexts, prior to S.C. Johnson's laboratory's work relating to U.S. patent application Ser. No. 11/689,696 entitled "CLEANING IMPLEMENT," filed Mar. 22, 2007, and S.C. Johnson's laboratory's work relating to PCT application US07/07103 entitled "CLEANING IMPLEMENT" filed Mar. 22, 2007, applicants are not aware of anyone having provided a compact replaceable cartridge that delivers cleaning fluid, squeegees it off the window, and absorbs it. These applications are incorporated herein by reference as if fully set forth herein.

Such devices have a pad mounted below a squeegee. The pad both applies cleaning fluid and reabsorbs dirtied cleaning liquid after it is driven off a window by the squeegee. Specialized filtering material is preferably used in this system so that the reabsorbed liquid can be reused. However, the squeegee is designed to work in one direction so that after dragging a squeegee down along a window the movement back up of the squeegee isn't designed for use to clean the window.

Some squeegee devices have been developed (most notably in connection with automobile windshield wipers) which permit squeegeeing in multiple directions. See e.g. U.S. Pat. Nos. 1,828,715, 2,631,326 and 2,644,974. However, these systems were not designed to also deliver cleaning fluid from the same squeegee tool, or collect used cleaning fluid.

Hence, there is a need for improved cleaning implements of a multi-functional type, particularly with respect to ability to operate in multiple directions without loss of function in a system that both delivers cleaning liquid and recovers it.

BRIEF SUMMARY OF THE INVENTION

The present invention relates to a cleaning implement for cleaning a hard surface. There is a squeegee blade sandwiched by a first segment of porous material on a first side and by a second segment of porous material on a second side, the squeegee blade having a projecting contact edge. There is also a support for mounting the squeegee blade and also the first and second segments of porous material.

If the projecting contact edge is dragged in a first direction across a portion of the hard surface to which a cleaning liquid has been applied, that cleaning liquid can be thereby squeegeed off the hard surface and absorbed by the first segment. If instead the projecting contact edge is dragged in a second direction opposite the first direction across a portion of a hard surface to which a cleaning liquid has been applied, that cleaning liquid can be instead thereby squeegeed off the hard surface and absorbed by the second segment. Both the first segment and the second segment are suitable to remain essentially rigid as the cleaning liquid is being squeegeed off the hard surface. Preferably at least one of the first and second segments has a contact surface which is curved or angled, such as where the contact surface is suitable to scrub the hard surface (e.g. a fibrous rough surface).

In another form the invention provides a cleaning implement for cleaning a hard surface. There is a squeegee blade sandwiched by a first segment of porous material on a first side and by a second segment of porous material on a second side, the squeegee blade having a projecting contact edge. There is also a support for mounting the squeegee blade and first and second segments of porous material.

As before, if the contact edge is dragged in a first direction across a portion of the hard surface to which a cleaning liquid has been applied, that cleaning liquid can be thereby squeegeed off the hard surface and absorbed by the first segment. Also, if instead the contact edge is dragged in a second direction opposite the first direction across a portion of the hard surface to which a cleaning liquid has been applied, that cleaning liquid can be instead thereby squeegeed off the hard surface and absorbed by the second segment. In this embodiment the first and second segments are made of a fibrous slab material selected from the group consisting of polyester fiber, polypropylene fiber, cellulose acetate fiber, and bonded polyolefin fiber.

In especially preferred forms at least one of the first and second segments has an inset area adjacent to the squeegee blade to facilitate collecting used cleaning fluid, and an outwardly extending portion more remote from the squeegee blade suitable to contact the surface being cleaned. Also, the support is in the form of a housing having a forward opening suitable to removably receive the squeegee blade and first and second segments.

In another preferred form the support is in the form of a support head that clamps the squeegee blade and also the first and second segments. There can also be a handle linked to the support head.

In yet another aspect the invention provides a cleaning implement for cleaning a hard surface which has a squeegee blade against which is mounted a first segment of porous material. The first segment is mounted along an upper side of the blade with the squeegee blade having a forward projecting contact edge and at least one aperture (e.g. a generally cylindrical aperture) extending through the squeegee blade from a lower side of the blade to the upper side of the blade. The aperture may have capillary grooves along the aperture, which are linked to additional capillary grooves formed along a lower side of the squeegee blade.

This embodiment can also have a second segment of porous material mounted along a lower side of the squeegee blade, particularly where the second segment of porous material is configured and suitable to scrub the hard surface.

Most preferably the second segment is capable of delivering cleaning liquid to the hard surface, the squeegee blade is capable of squeegeeing used cleaning liquid off the hard surface once cleaning liquid has been applied to that surface, and used cleaning liquid removed by the squeegee blade is capable of traveling from the lower side of the squeegee blade up through the squeegee blade to the first segment of porous material.

While it is preferred to use slabs capable of delivering cleaning fluid, and then also re-absorbing used cleaning fluid, in the broadest aspects the invention does not require the cleaning implement itself to deliver the cleaning fluid. For example, one could spray Windex® brand window cleaner on a window from a conventional spray bottle, and then use an embodiment of the invention to remove used cleaning liquid, albeit with multi-direction squeegee motion.

Alternatively, in the forms having an apertured squeegee blade the squeegee blade is capable of squeegeeing used cleaning liquid off the hard surface once cleaning liquid has been applied to that surface, and used cleaning liquid removed by the squeegee blade is capable of traveling (being driven and wicked) from the lower side of the squeegee blade up through the squeegee blade to the first segment of absorbent to be collected by that absorbent. Hence, the lower absorbent segment delivers fresh cleaning liquid and is kept essentially separate from the used cleaning liquid.

Each substrate preferably is formed from a slab of a porous absorbent material, such as a fibrous filtering material selected from the group consisting of polyester fiber, polypropylene fiber, cellulose acetate fiber, and bonded polyolefin fiber. While the substrate may have some slight flexibility, it is preferably sufficiently rigid that forces transferred from the squeegee blade during use will not cause the substrate to flex in the direction of the squeegee blade forces.

Particularly preferred absorbents are polyester fiber materials, polypropylene fiber materials, cellulose acetate fiber materials, and bonded polyolefin fiber materials available from Filtrona Richmond Inc. (Colonial Heights, Va.). Alternatively, one could use a porous polyethylene material available from Porex or a cellulosic pad with horizontal capillary fibers made of plastic to improve integrity and water transport. Another possibility is to use a melamine foam.

Also, that type of material could be used for the second segment, with a less expensive absorbent used above the squeegee blade (e.g. a cellulosic wad).

Such devices are most suitable for cleaning building windows. However, they can also be used for cleaning automobile windows and other hard surfaces such as those found in bathing and showering areas or on counter tops. A variety of cleaning liquids can be used ranging from water to specialized window cleaners, to other hard surface cleaning fluids.

In sum, the present invention accomplishes the applying, squeegeeing and absorbing steps while providing options for use in multiple directions and/or to more completely separate used cleaning liquid from fresh cleaning liquid. Such devices are inexpensive to manufacture.

The foregoing and other advantages of the present invention will become apparent from the following description. In that description reference is made to the accompanying drawings which form a part thereof, and in which there is shown by way of non-limiting illustration preferred embodiments of the invention.

BRIEF DESCRIPTION OF THE DRAWINGS

FIG. 5 is a view similar to FIG. 4, but showing how the FIG. 4 device can work when pushed upwardly along a window or the like;

FIG. 6 is a view similar to FIG. 2, but of another embodiment;

FIG. 7 is a view similar to FIG. 3 but of the FIG. 6 device;

FIG. 13 is a sectional view taken along line 13-13 of FIG. 12; and

FIG. 14 is a lower partial perspective view of the FIG. 12 squeegee blade.

DETAILED DESCRIPTION OF THE PREFERRED EMBODIMENTS

Figure 1:
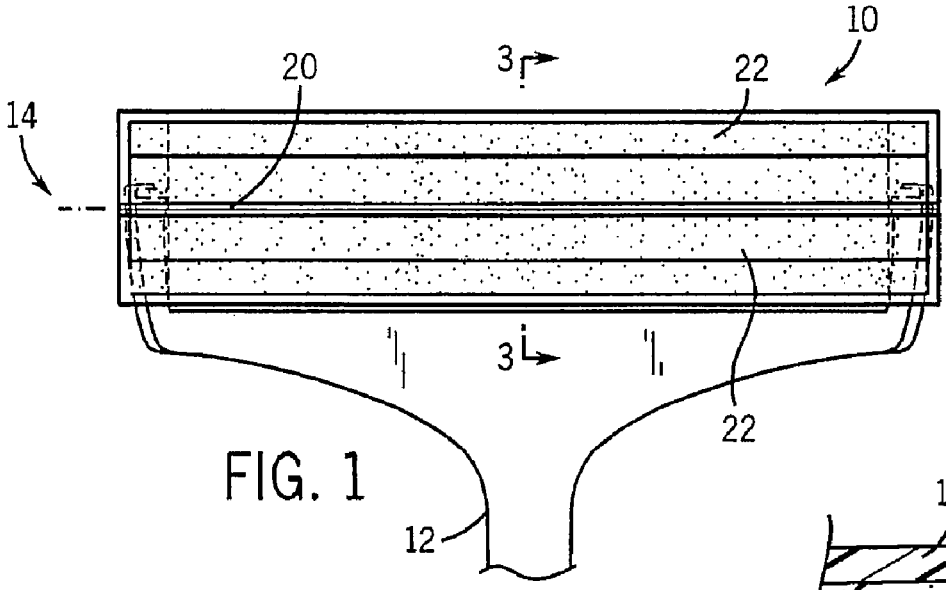
FIG. 1 is a front elevational view of an upper portion of an embodiment of the present invention.
Figure 2:
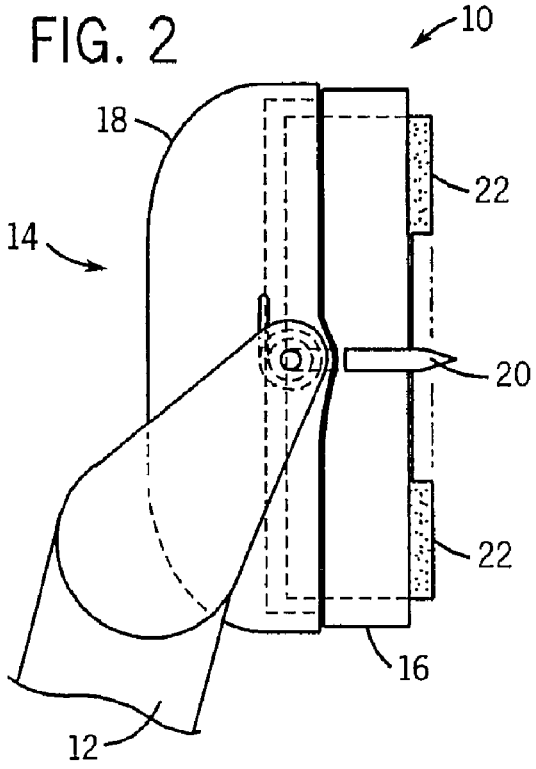
FIG. 2 is a left side elevational view thereof.
Figure 3:
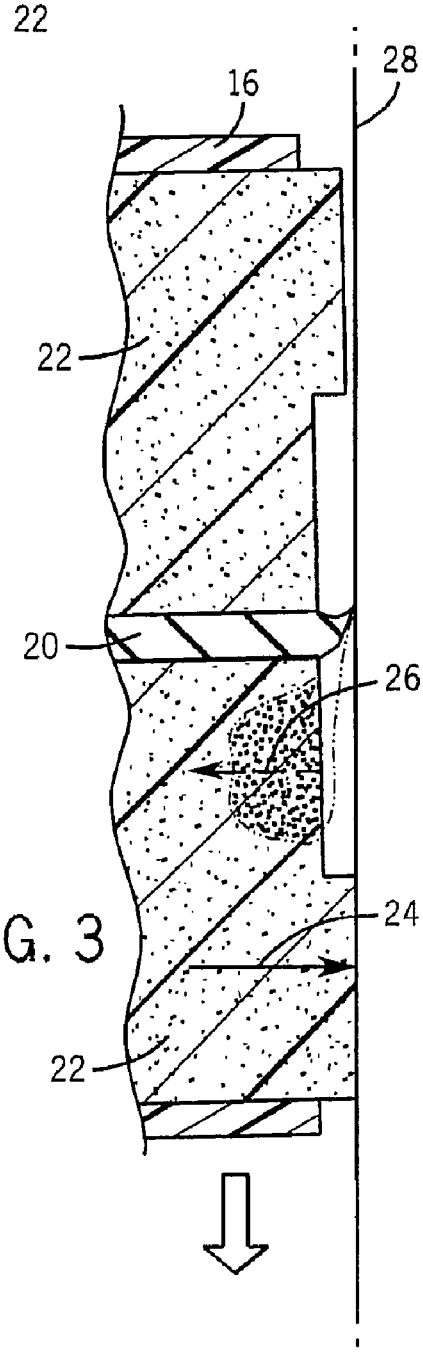
FIG. 3 is an enlarged sectional view taken along line 3-3 of FIG. 1.
Figure 4:
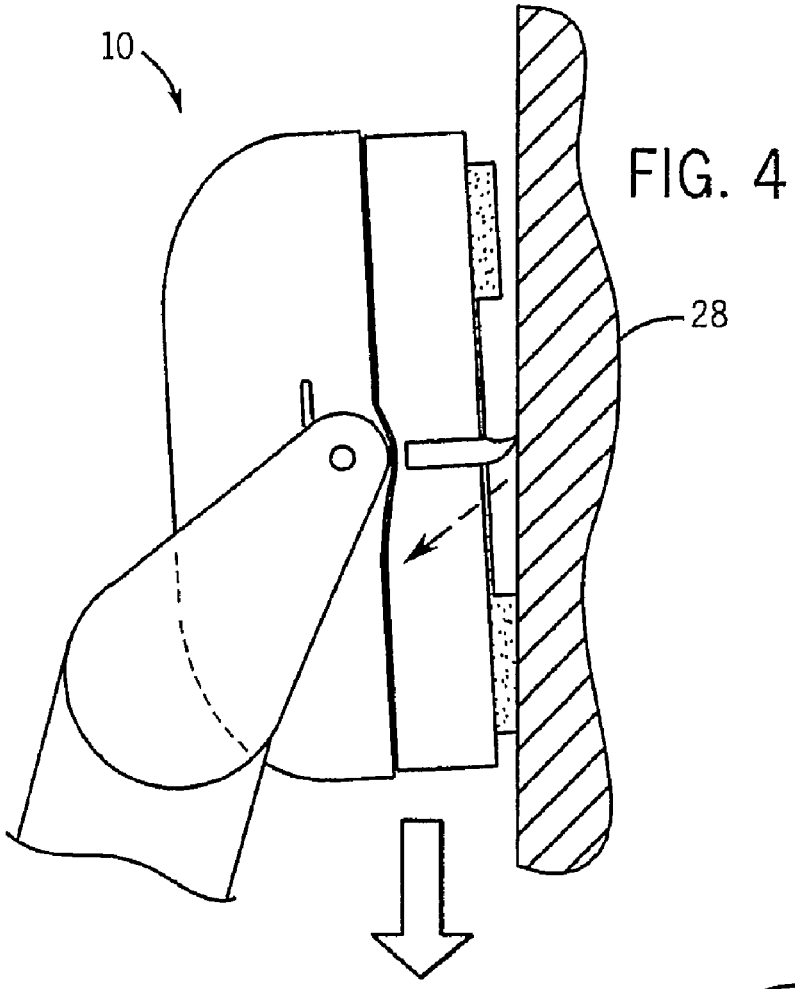
FIG. 4 is a view similar to FIG. 2, showing first how that device can be used with a downward pull.

Referring first to the embodiment of FIGS. 1-5, there is shown a cleaning device 10 having a gripping handle 12 linked to a support head 14. A replaceable cartridge 16 is mounted on the support head via a pivotable holder 18.

The cartridge 16 has a squeegee blade 20, which is sandwiched by two porous substrates 22 positionable below and above the squeegee blade. The substrates are preferably mirror images of each other, made of identical material such as Filtrona brand plastic fiber material, and impregnated with a window cleaner such as Windex® brand window cleaner.

Such a substrate structure will result in a substrate that can dispense such a cleaning fluid on contact as at 24, and additionally collect the used cleaning fluid as at 26, and then reprocesses it for further use.

Figure 5:
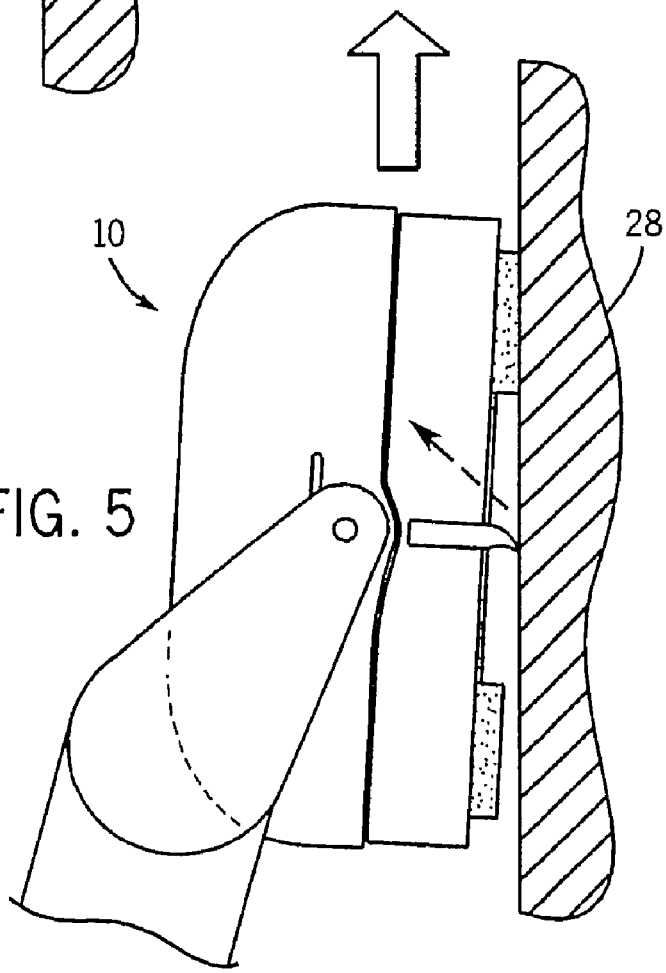

However, because two of these substrates are now used, in mirror image fashion, the device has the capability of cleaning a surface 28 both on the downstroke (FIG. 4) and the upstroke (FIG. 5). This is achieved in the FIG. 1 embodiment by allowing a pivoting of the support head. Another approach is depicted in FIGS. 6 and 7. There the cleaning implement 30 has its substrate 32 provided with a curved face 34. This alternatively could be achieved with angled surfaces.

Figure 8:
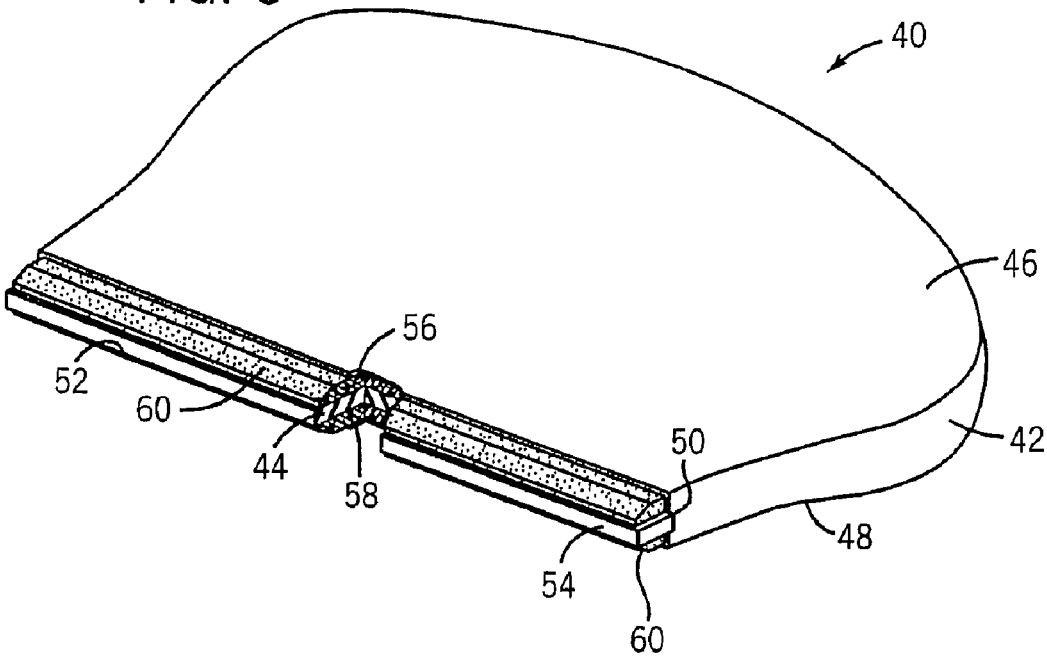
FIG. 8 is a right upper frontal perspective view of a third embodiment of the present invention, with a portion broken away.

In the FIG. 8 device there is no extension handle. Rather, the compact cleaning implement 40 has a short clamshell housing 42 with housing parts 46 and 48. The housing has a frontal opening for receiving a replaceable cartridge. The cartridge has a squeegee blade 44 sandwiched on its upper and lower sides 50/52 by substrate pieces 56/58, which are tapered at the front at 60. This device may be particularly of interest for performing touch-ups at the corners of windows, or for cleaning oddly shaped windows.

Figure 10:
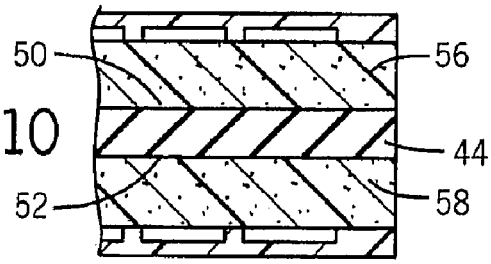
FIG. 10 is a sectional view taken along line 10-10 of FIG. 9.
Figure 9:
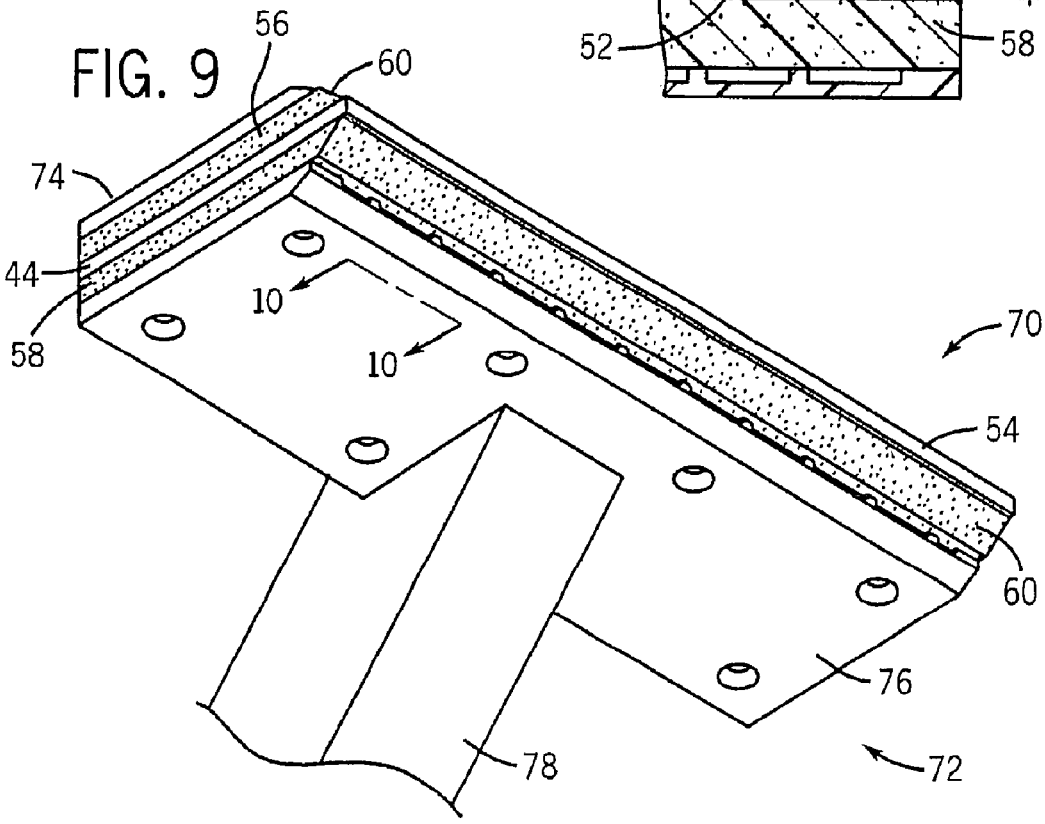
FIG. 9 is a lower left frontal perspective view of a fourth embodiment of the present invention.
Figure 11:
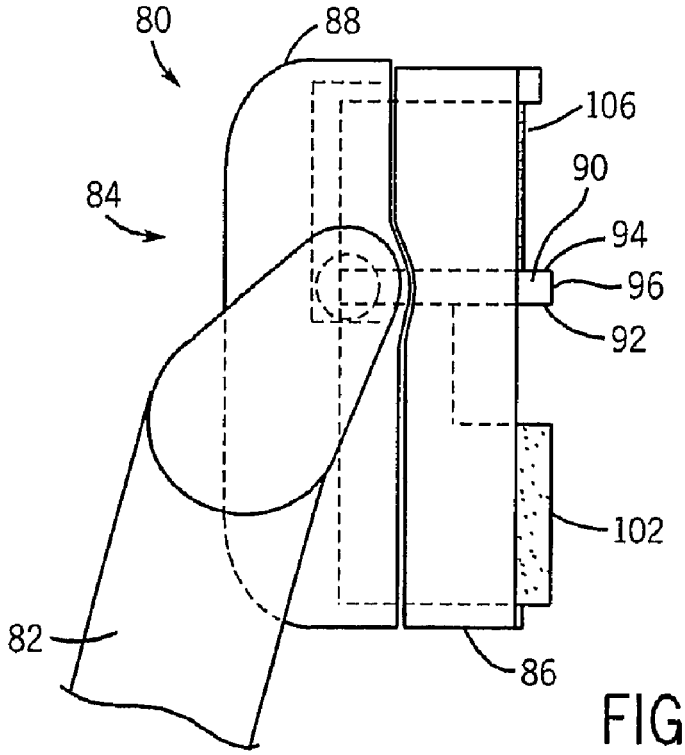
FIG. 11 is a view similar to FIG. 2 but of a fifth embodiment.
Figure 12:
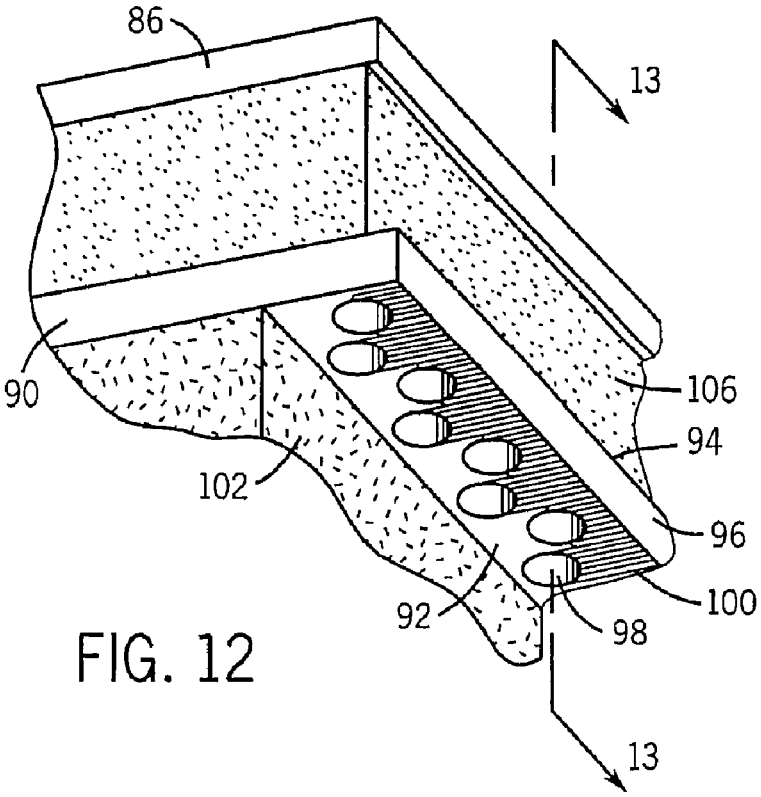
FIG. 12 is an enlarged fragmentary perspective view of the FIG. 11 embodiment.

Further details about this replaceable cartridge will be appreciated from reviewing FIGS. 9 and 10 as in that set of drawings the cartridge is the same as in the FIG. 8 embodiment, albeit the outer housing 42 is replaced with a different holder system. In this regard, cleaning implement 70 (FIGS. 9 and 10) includes squeegee blade 44 with first substrate structure 56 mounted on one side and second substrate structure 58 mounted on another side of the squeegee blade.

However, implement 70 includes a support head 72 mounting the replaceable cartridge between a first support side 74 and a second support side 76, optionally with bolts or other fasteners. Support head 72 is configured for attaching to a fixed handle 78.

In the further alternative embodiment of FIGS. 11-14 cleaning implement 80 includes handle 82 pivotably linked to a support head 84. A replaceable cartridge 86 is mountable on the support head via a pivotable holder 88. Support head 84 mounts a squeegee blade 90. Here it is preferred to use this design only in a single direction because of the special nature of the squeegee blade.

In this regard, squeegee blade 90 now includes a first side 92, a second side 94, a front side 96 and at least one aperture 98 and extending through the blade. Each aperture 98 has a plurality of associated capillaries 100 which extend from a front side 96 of the squeegee blade to the lower edge of the aperture, and then up the aperture. Most preferably, the capillary 100 start slightly rearwardly of the front edge of the squeegee blade so that the blade has a smooth contact edge.

As can be appreciated from FIG. 13, this allows substrate portion 102 to deliver cleaning fluid via contact at 104. Dirtied cleaning fluid will then be dragged down off the window by the squeegee and begin to collect along capillaries 100. The dirtied liquid will then be driven/capillaried up through the apertures 98 to the absorbent 106. Hence, the used liquid is kept separate from the clean liquid.

It is believed that the preferred inner diameters of the capillaries should normally be between 2 and 5 mm, most preferably about 3 mm. It is also preferred that the entrances of the capillaries should be essentially circular.

While this embodiment does not recycle the sullied cleaning liquid (and thus has a shorter useful life per refill), it permits the lower substrate to be made of less expensive materials.

While preferred embodiments of the present invention have been disclosed herein, it should be recognized that still other alternative embodiments are also intended to be protected by this patent. For example, the handle/retainer housing used with such devices is not critical (e.g. the support head need not be pivotable relative to the handle). Moreover, it is not critical that the squeegee blade and/or absorbent be part of a replaceable unit.

This application is therefore intended to cover a variety of other embodiments beyond the specific ones disclosed.

INDUSTRIAL APPLICABILITY

The present invention provides multifunction cleaning devices for windows or the like, particularly where such devices can operate in multiple directions, and/or segregate fresh cleaning fluid from used cleaning fluid.

What is claimed is:

1. A cleaning implement for cleaning a hard surface, comprising:

a squeegee blade sandwiched by a first segment of porous material on a first side and by a second segment of porous material on a second side, the squeegee blade having a projecting contact edge;

a support for mounting the squeegee blade and also the first and second segments of porous material;

wherein if the projecting contact edge is dragged in a first direction across a portion of the hard surface to which a cleaning liquid has been applied, that cleaning liquid can be thereby squeegeed off the hard surface and absorbed by the first segment;

wherein if instead the projecting contact edge is dragged in a second direction opposite the first direction across a portion of a hard surface to which a cleaning liquid has been applied, that cleaning liquid can be instead thereby squeegeed off the hard surface and absorbed by the second segment; and wherein both the first segment and the second segment are suitable to remain essentially rigid as the cleaning liquid is being squeegeed off the hard surface; and wherein at least one of the first and second segments has an inset area adjacent to the squeegee blade to facilitate collecting used cleaning fluid in an open pocket defined by the inset area and squeegee blade, and an outwardly extending portion more remote from the squeegee blade suitable to contact a surface being cleaned.

2. The cleaning implement of claim 1, wherein at least one of the first and second segments has a contact surface which is curved or angled.

3. The cleaning implement of claim 2, wherein the contact surface is also suitable to scrub the hard surface.

4. A cleaning implement for cleaning a hard surface, comprising:

a squeegee blade sandwiched by a first segment of porous material on a first side and by a second segment of porous material on a second side, the squeegee blade having a projecting contact edge;

a support for mounting the squeegee blade and first and second segments of porous material;

wherein if the contact edge is dragged in a first direction across a portion of the hard surface to which a cleaning liquid has been applied, that cleaning liquid can be thereby squeegeed off the hard surface and absorbed by the first segment;

wherein if instead the contact edge is dragged in a second direction opposite the first direction across a portion of the hard surface to which a cleaning liquid has been applied, that cleaning liquid can be instead thereby squeegeed off the hard surface and absorbed by the second segment;

wherein at least one of the first and second segments has an inset area adjacent to the squeegee blade to facilitate collecting used cleaning fluid in an open pocket defined by the inset area and squeegee blade, and an outwardly extending portion more remote from the squeegee blade suitable to contact a surface being cleaned; and wherein at least one of first and second segments comprises a fibrous slab material selected from the group consisting of polyester fiber, polypropylene fiber, cellulose acetate fiber, and bonded polyolefin fiber.

5. The cleaning implement of claim 4, where the support is in a form of a housing having a forward opening suitable to removably receive the squeegee blade and first and second segments.

6. The cleaning implement of claim 4, wherein the support is in a form of a support head that clamps the squeegee blade and also the first and second segments, and there is a handle linked to the support head.

7. A cleaning implement for cleaning a hard surface, comprising a squeegee blade against which is mounted a first segment of porous material, the first segment being mounted along an upper side of the blade, the squeegee blade having a forward projecting contact edge and at least one aperture extending through the squeegee blade from a lower side of the blade to the upper side of the blade;

wherein the aperture has capillary grooves extending axially along the aperture.

8. The cleaning implement of claim 7, wherein the capillary grooves axially extending along the aperture are linked to additional transversely extending capillary grooves formed along a lower side of the squeegee blade.

9. The cleaning implement of claim 7, wherein there is a second segment of porous material mounted along a lower side of the squeegee blade.

10. The cleaning implement of claim 9, wherein the second segment of porous material is configured and suitable to scrub the hard surface.

11. The cleaning implement of claim 9, wherein the second segment is capable of delivering cleaning liquid to the hard surface, the squeegee blade is capable of squeegeeing used cleaning liquid off the hard surface once cleaning liquid has been applied to that surface, and used cleaning liquid removed by the squeegee blade is capable of traveling from the lower side of the squeegee blade up through the squeegee blade to the first segment of porous material.

12. The cleaning implement of claim 7, wherein the aperture is cylindrical.

* * * * *